US007000673B2

(12) United States Patent
Cook

(10) Patent No.: US 7,000,673 B2
(45) Date of Patent: Feb. 21, 2006

(54) VERTICALLY AND HORIZONTALLY SWINGING GATE

(75) Inventor: Edmond A. Cook, Lusk, WY (US)

(73) Assignee: EC Ranch, Lusk, WY (US)

( * ) Notice: Subject to any disclaimer, the term of this patent is extended or adjusted under 35 U.S.C. 154(b) by 65 days.

(21) Appl. No.: 10/798,503

(22) Filed: Mar. 11, 2004

(65) Prior Publication Data

US 2005/0150612 A1 Jul. 14, 2005

Related U.S. Application Data

(63) Continuation-in-part of application No. 10/753,552, filed on Jan. 8, 2004.

(51) Int. Cl.
*E05D 15/00* (2006.01)

(52) U.S. Cl. ..... 160/210; 49/226; 49/232; 49/501

(58) Field of Classification Search ..... 160/152, 160/160, 165, 210, 212, 218; 49/501, 226, 49/232, 233; 256/73, 31, 24, 26
See application file for complete search history.

(56) References Cited

U.S. PATENT DOCUMENTS

| | | | | |
|---|---|---|---|---|
| 485,197 | A | 11/1892 | Jacobs | |
| 559,331 | A * | 4/1896 | Hood | 49/160 |
| 582,427 | A | 5/1897 | Keller | |
| 629,529 | A | 7/1899 | Simmons | |
| 888,844 | A * | 5/1908 | Peters | 119/415 |
| 1,091,652 | A * | 3/1914 | Hall | 160/160 |
| 1,095,459 | A | 5/1914 | Davis | |
| 1,532,769 | A * | 4/1925 | McElroy | 160/137 |
| 2,534,986 | A * | 12/1950 | Gunnar et al. | 280/42 |
| 2,835,475 | A | 5/1958 | Enghauser | |
| 4,030,255 | A | 6/1977 | Hartman | |
| 4,658,543 | A * | 4/1987 | Carr | 49/139 |
| 5,362,030 | A | 11/1994 | Iler, Jr. et al. | |
| 5,440,838 | A * | 8/1995 | Lesser | 49/340 |
| 6,279,880 | B1 | 8/2001 | Hawks, Jr. | |
| 6,611,992 | B1 * | 9/2003 | Arnaud | 16/239 |
| 2003/0122117 | A1 | 7/2003 | Brown | |
| 2003/0136955 | A1 | 7/2003 | Platt | |

* cited by examiner

*Primary Examiner*—Blair M. Johnson
(74) *Attorney, Agent, or Firm*—Antoinette M. Tease

(57) ABSTRACT

A gate apparatus comprising a first frame, a second frame and a plurality of rails, wherein each of the first and second frames comprises a vertical post and a plurality of cross-bars, and wherein the cross-bars of the first frame increase in length from the top cross-bar to the bottom cross-bar, and the difference in length between each cross-bar and the one below it is at least equal to the width of each rail, and wherein the cross-bars of the second frame increase in length from the bottom cross-bar to the top cross-bar, and the difference in length between each cross-bar and the one above it is at least equal to the width of each rail. The gate apparatus includes a means of attaching the rails to the cross-bars that allows the rails to pivot vertically. A wheel is attached to the vertical post of the second frame.

5 Claims, 12 Drawing Sheets

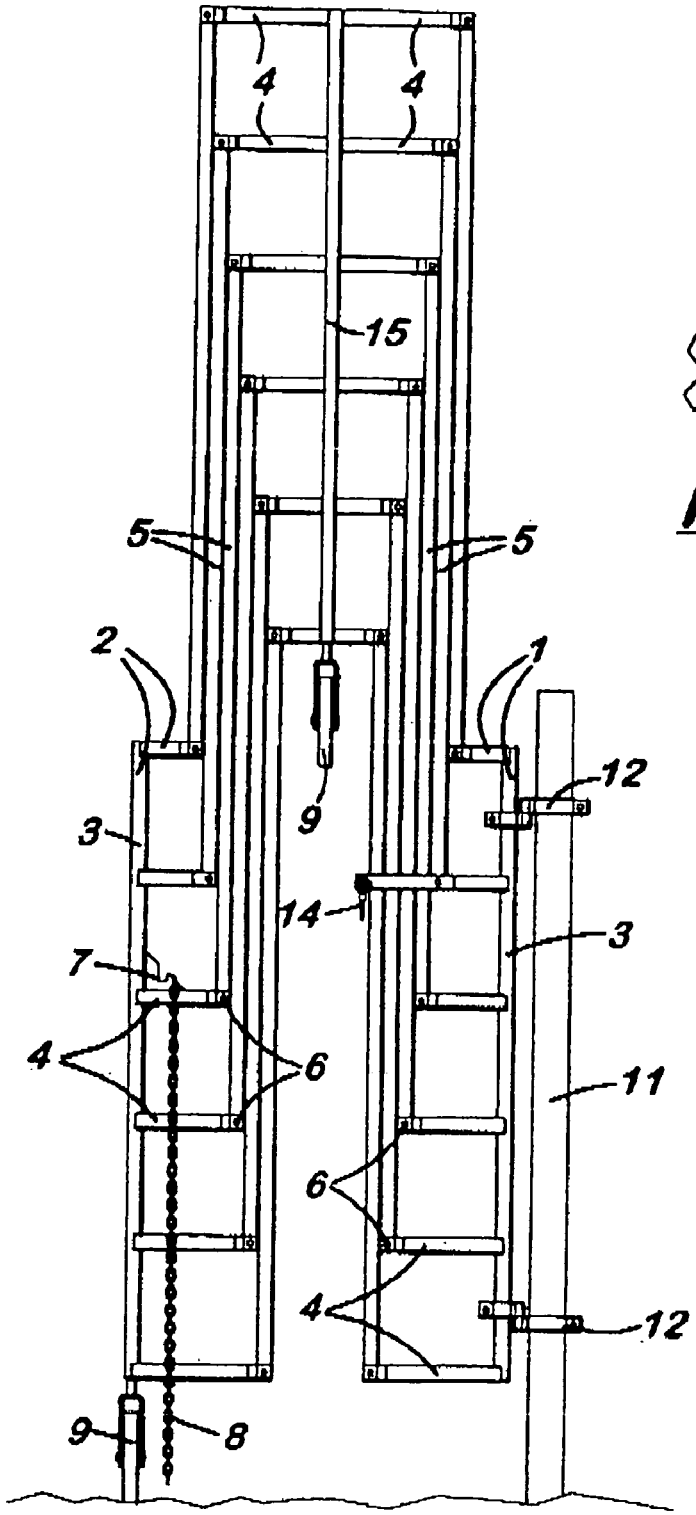
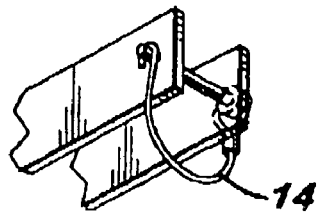
Fig. 11A
Fig. 11

VERTICALLY AND HORIZONTALLY SWINGING GATE

CROSS-REFERENCE TO RELATED APPLICATION

This application is a continuation-in-part of U.S. patent application Ser. No. 10/753,552, filed on Jan. 8, 2004.

BACKGROUND OF THE INVENTION

1. Field of the Invention

The present invention relates to the field of gates, and more particularly, gates used for agricultural and ranching purposes. The present invention provides a unique vertically and horizontally swinging gate that allows farmers and ranchers to place gates in situations where the terrain is uneven and that is designed to maintain the durability of the gate over long periods of use.

2. Description of the Related Art

One of the problems faced by farmers and ranchers is the inability of currently available gates to maintain a constant distance between the bottom of the gate and the ground while the gate is opened and closed over uneven terrain, such as a ditch or snow bank. A widely used gate for agricultural and ranching purposes is the POWDER RIVER gate, which consists generally of a series of evenly spaced horizontal steel tubes. The gate does not swivel vertically, and it does not maintain a constant distance between the bottom of the gate and the ground over differing levels of terrain as the gate opens and closes.

One inventor attempted to solve this problem over a century ago by coming up with a farm or stock-yard gate that was constructed so that it could be lifted clear of the ground to a maximum of forty-four degrees from the gate post and opened or shut in that position. U.S. Pat. No. 582,427 (Keller, 1897). Unlike the present invention, the gate of the Keller invention could not swing to a full vertical position, it could not swing downward as well as upward, and the mechanism that allowed the gate to swivel—a double rail system—is vastly different from and much less versatile than that of the present invention.

Various other railing-type mechanisms have been devised to deal with the issue of uneven ground, but none of these inventions is a gate, and therefore none of these inventions provides a railing that is able to maintain its distance to the ground while moving horizontally. One example of a vertically adjustable railing-type mechanism that is not a gate is the temporary fall protection system described in U.S. Pat. No. 6,279,880 (Hawks, Jr., 2001). The Hawks system comprises fixed length guard rails and pivot stanchions, and it is intended to be deployed on construction sites over stairs or similarly uneven surfaces.

Another example is the interchangeable fence or guard rail structure of U.S. Pat. No. 2,835,475 (Enghauser, 1958). The Enghauser invention comprises support posts and prefabricated rail sections, wherein each rail section has a pair of longitudinal stringers with spaced vertical palings pivotally connected to the stringers. The latter invention was intended to be used on porches to provide a hand rail and to prevent people from falling off the porch.

U.S. Patent Application Publication No. U.S. 2003/0122117 (Brown) discloses another modular railing system for construction sites that utilizes baluster units to connect the rail sets. As with the Hawks and Enghauser inventions, the Brown invention is not a gate, and it does not address the problem of opening and closing a gate over uneven terrain.

In addition to the patents described above, there are three patents, all issued approximately a century ago, that attempt to deal with the issue of providing greater flexibility in fences. In U.S. Pat. No. 629,529 (Simmons, 1899), the inventor described a portable fence that could be erected on level or hilly ground. The fence rails of the Simmons invention were pivotally connected to the vertical bars, which allowed the fence panel to be installed "in a true horizontal position or at a slight inclination."

In U.S. Pat. No. 1,095,459 (Davis, 1914), the inventor disclosed a fence with sections that move vertically in relation to the fence posts. The fence rails of the Davis invention could be moved upward, but not to the degree of the present invention, and they could not be moved horizontally.

Lastly, U.S. Pat. No. 485,197 (Jacobs, 1892) provides a fence design that was intended to overcome the tendency of a fence to collapse endwise. The Jacobs invention entails binding the posts and rails of each fence panel together at their points of intersection. In addition to overcoming the problem of opening a gate over uneven terrain, the present invention also tackles the problem that Jacobs sought to solve, namely, the problem of fence collapse. The present invention addresses this issue by redistributing some of the weight of the gate from the gate posts and rails to a moveable post with a wheel that rests on the ground. This novel design ensures the gate's long-lasting durability.

BRIEF SUMMARY OF THE INVENTION

The present invention relates to a gate apparatus that is able to swing both horizontally and vertically at the same time and that can be compacted for storage to a size that is approximately twenty percent (20%) that of standard welded gates. The gate can swing vertically to a full ninety degrees from the true horizontal position, and it can also swing eighty degrees downward. By virtue of this unique functionality, the gate of the present invention can operate on uneven terrain and in situations in which more traditional gates would not work. In addition, the present invention solves the problem of gate collapse by evenly distributing the weight of the gate between a first frame and gate post, on the one hand, and a second frame and wheel, on the other hand.

More specifically, the present invention covers a gate apparatus comprising a first frame, a second frame and a plurality of rails, wherein each of the first and second frames comprises a vertical post and a plurality of cross-bars, and wherein the cross-bars of the first frame increase in length from the top cross-bar to the bottom cross-bar, and the difference in length between each cross-bar and the one below it is at least equal to the width of each rail, and wherein the cross-bars of the second frame increase in length from the bottom cross-bar to the top cross-bar, and the difference in length between each cross-bar and the one above it is at least equal to the width of each rail. The present invention further comprises a means of attaching the rails to the cross-bars that allows the rails to pivot vertically in relation to the cross-bars. It also comprises a wheel and a means of attaching the wheel to the vertical post of the second frame.

Optionally, the present invention can include a chain hook attached to the first and/or second frames, a chain that is attached to the chain hook, and a center support attached to the rails. The center support can be single or double pivoting. A spring clip pin arrangement can be used in lieu of the chain-and-hook arrangement. In the preferred embodiment, the present invention also includes adjustable hinges that can be moved up or down on or rotated around the gate post. The number and length of the rails, as well as the type of hinges used, can vary depending upon the particular needs of customers.

BRIEF DESCRIPTION OF THE DRAWINGS

FIG. 11 is an elevated front view of the present invention with the rails swung to a complete vertical position and with the double pivoting center support.

FIG. 11A is a partial perspective view of the spring clip pin aspect of the present invention.

REFERENCE NUMBERS

Figure 1:
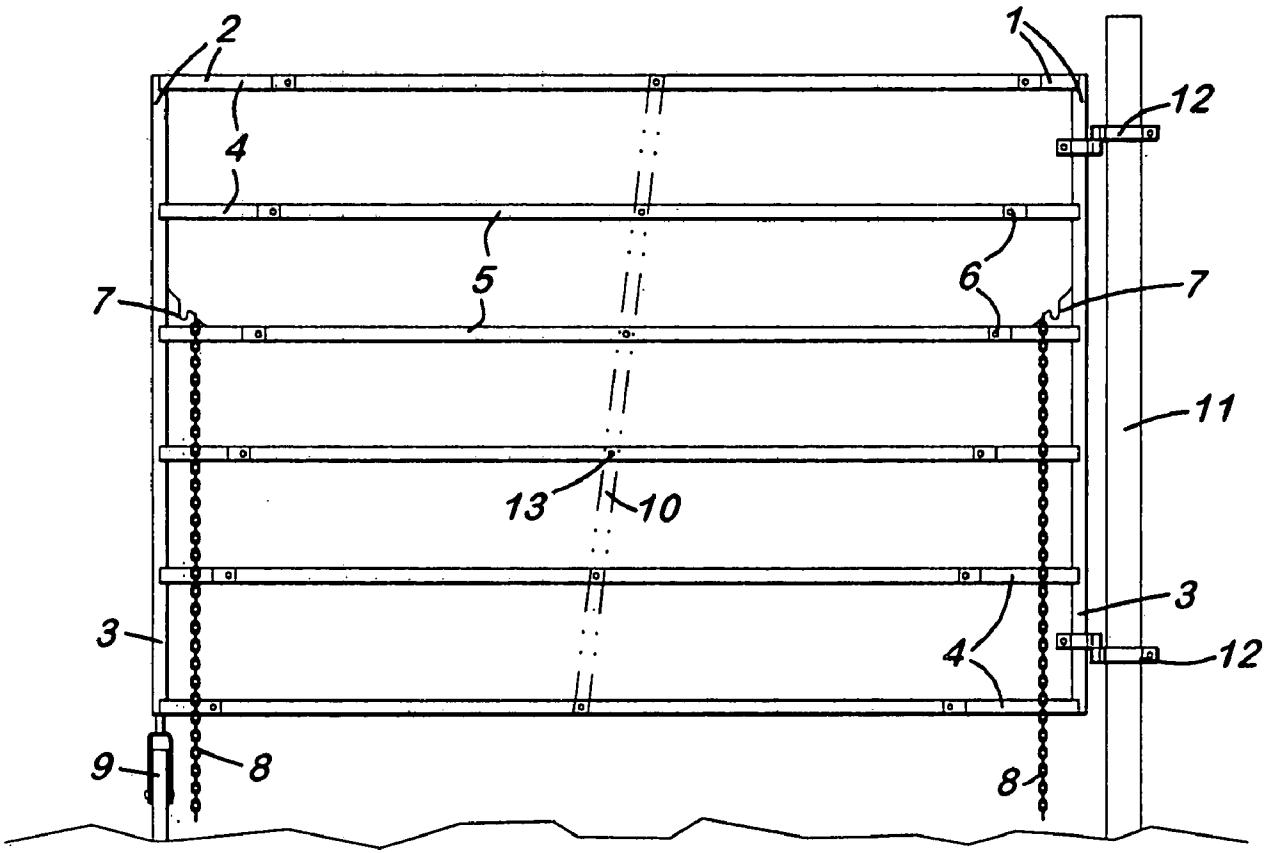
FIG. 1 is an elevated front view of the present invention in a true horizontal position without any vertical swing and with the chain-and-hook arrangement.

1 First frame
2 Second frame
3 Vertical post
4 Cross-bar
5 Rail
6 Pivot
7 Chain hook
8 Chain
9 Wheel
10 Center support
11 Gate post
12 Hinges
13 Bolts (center support)
14 Spring clip pin
15 Double pivoting embodiment of center support
16 Mud shoe

DETAILED DESCRIPTION OF INVENTION

FIG. 1 is an elevated front view of the present invention in a true horizontal position without any vertical swing. The present invention comprises a first frame 1 and a second frame 2. Each frame has a vertical post 3 and a series of cross-bars 4. The cross-bars 4 of the first frame 1 increase in length from the top cross-bar to the bottom cross-bar, and the difference in length between each cross-bar 4 and the one below it is at least equal to the width of each rail 5. The cross-bars 4 of the second frame 2 increase in length from the bottom cross-bar to the top cross-bar, and the difference in length between each cross-bar 4 and the one above it is at least equal to the width of each rail 5.

The present invention includes a number of rails 5 corresponding to the number of cross-bars 4. Each rail is connected by a pivot 6 to a cross-bar of the first frame 1 and a cross-bar of the second frame 2. On each frame, a chain hook 7 is attached to the vertical post 3 and one of the cross-bars 4. A chain 8 can be used to hold the rails in a completely vertical position (see FIG. 5) or to hold more than one gate panel together at the end opposite the gate post 11. In the preferred embodiment, the chain 8 is attached to the chain hook 7 at one end. Attached to the bottom of the vertical post 3 of the second frame 2 is a wheel 9. The wheel, in combination with the pivots 6, allows the gate to swing horizontally over uneven terrain while maintaining a constant distance between the bottom of the gate and the ground.

Figure 3:
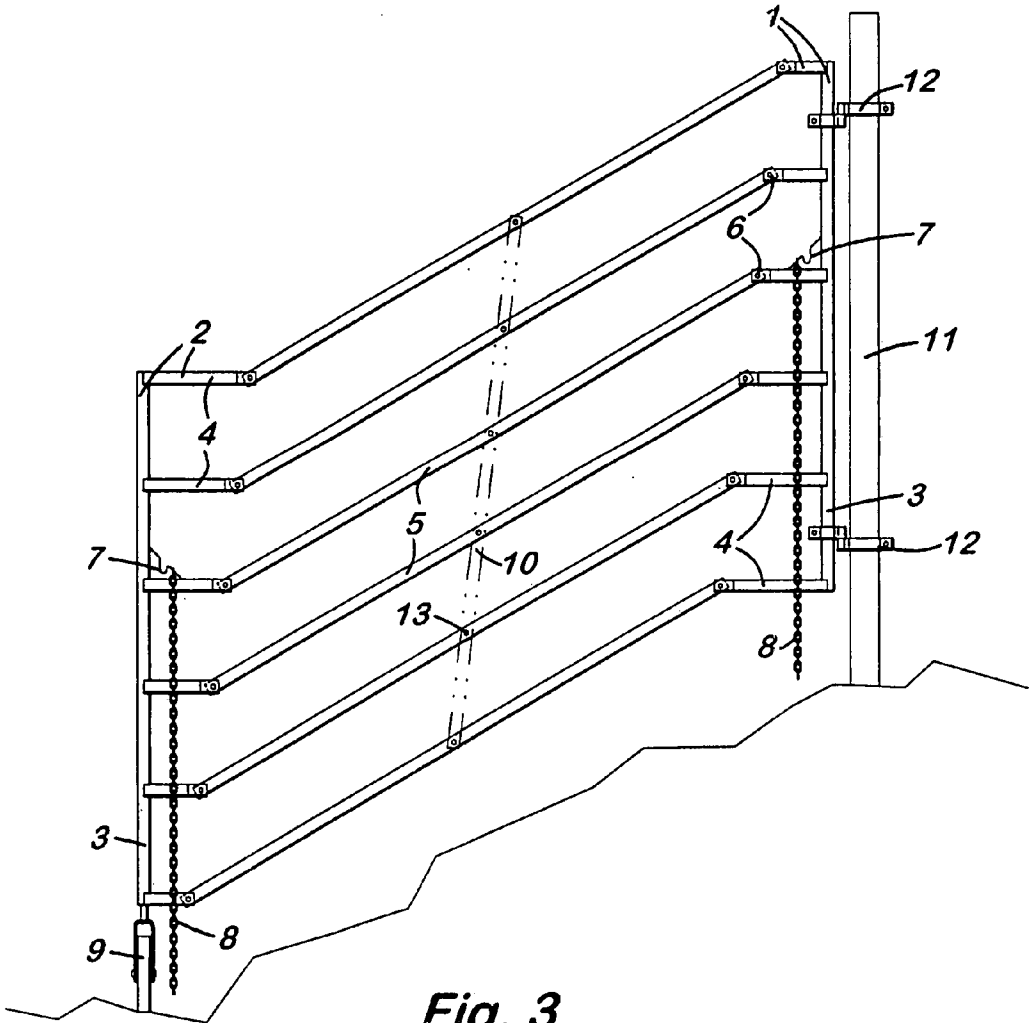
FIG. 3 is an elevated front view of the present invention with the rails swung downward.
Figure 4:
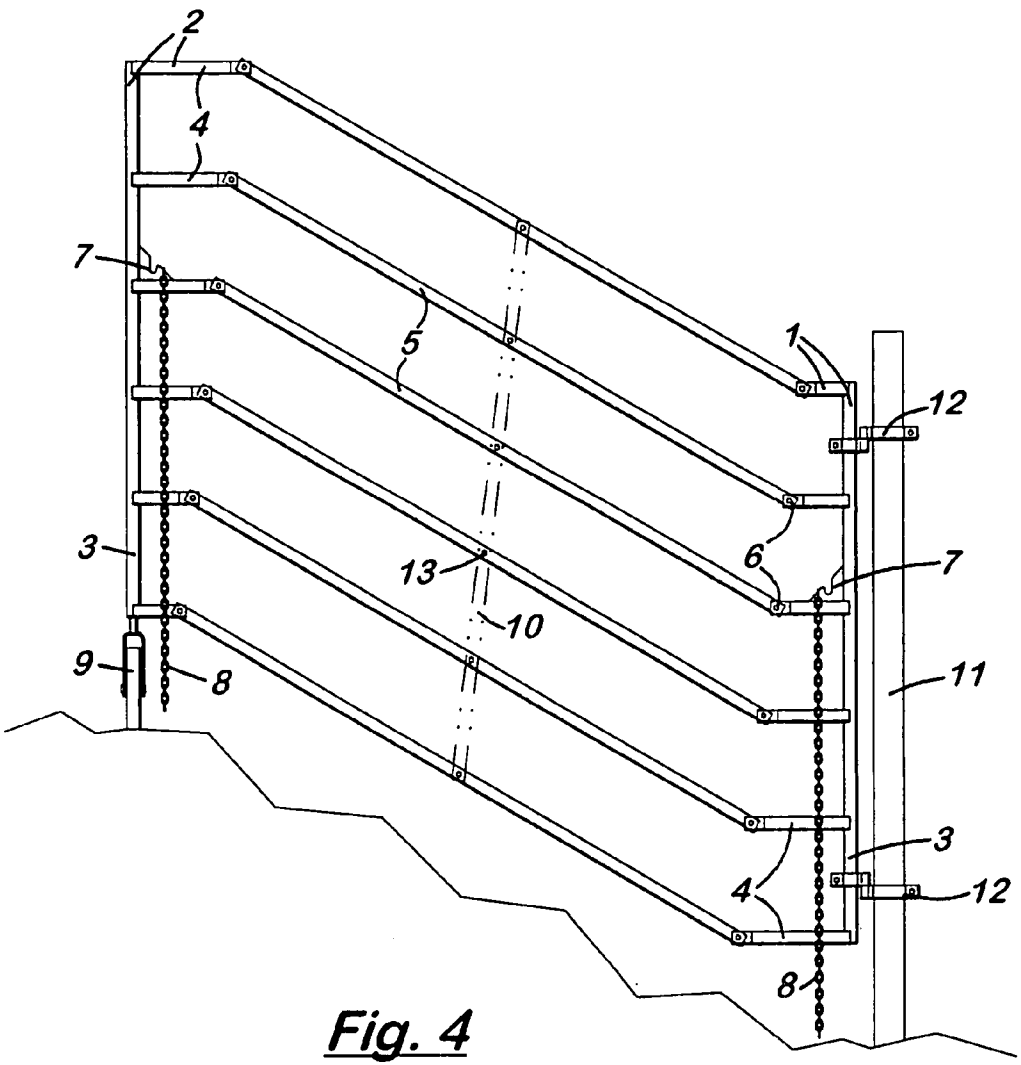
FIG. 4 is an elevated front view of the present invention with the rails swung upward.

The number and length of rails can vary, and a center support 10 can be added to provide additional support if desired. As shown in FIGS. 1, 3 and 4, the center support 10 is parallel to the line formed by the end of the pivots 6 on both the first and second frames. In the preferred embodiment, the center support 10 comprises two steel straps on either side of the rails 5. The center support 10 is attached to the rails 5 by bolts 13 that allow the center support 10 to pivot. If an animal tries to climb over the gate of the present invention, the design of the center support provides for even distribution of the animal's weight among all of the rails (rather than having all of the animal's weight placed on the top rail).

In the preferred embodiment, the rails are made of square steel tubing, and the vertical posts are made of round steel tubing. The first frame 1 is attached to a gate post 11 by means of hinges 12. The hinges 12 are adjustable and can be moved up or down or rotated on the vertical post 3 or the gate post 11.

Figure 2:
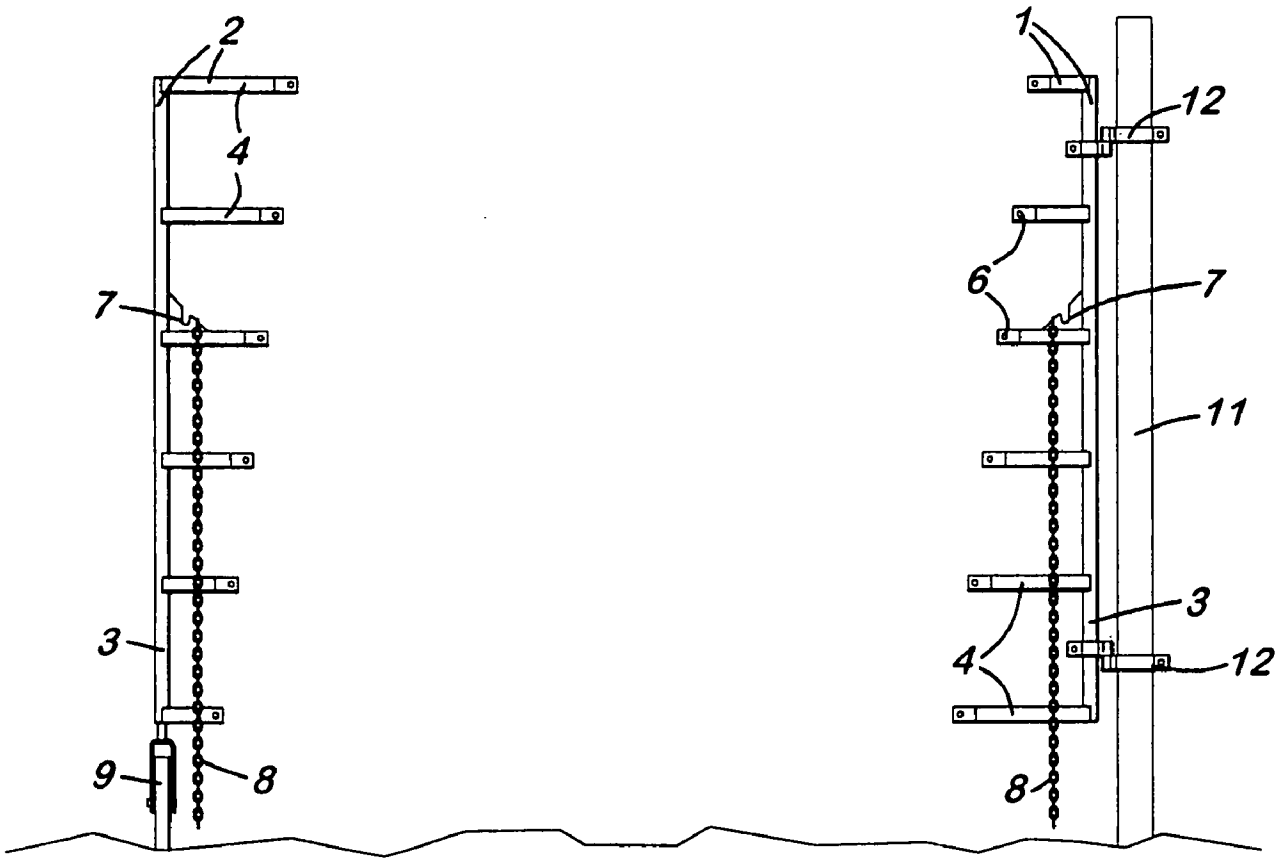
FIG. 2 is an elevated front view of the present invention without the rails.

FIG. 2 is an elevated front view of the present invention without the rails. This figure illustrates the unique design of the frame, which allows the rails to swing upward into a completely vertical position, unlike any other patented invention or commercialized product to date. As described above, the cross-bars 4 of the first frame 1 increase in length from the top cross-bar to the bottom cross-bar, and the difference in length between each cross-bar 4 and the one below it is at least equal to the width of each rail 5. The cross-bars 4 of the second frame 2 increase in length from the bottom cross-bar to the top cross-bar, and the difference in length between each cross-bar 4 and the one above it is at least equal to the width of each rail 5.

FIG. 3 is an elevated front view of the present invention with the rails swung downward. This figure shows the ability of the pivots 6 to allow the rails 5 to swing downward either while the gate is stationary or while the gate is in motion. FIG. 4 is an elevated front view of the present invention with the rails swung upward. This figure shows the ability of the pivots 6 to allow the rails 5 to swing upward either while the gate is stationary or while the gate is in motion. The gate can be swung horizontally while the rails are in a true horizontal, fully upright or fully downward position, and the ability of the gate to swing horizontally is independent of the vertical position of the rails.

Figure 5:
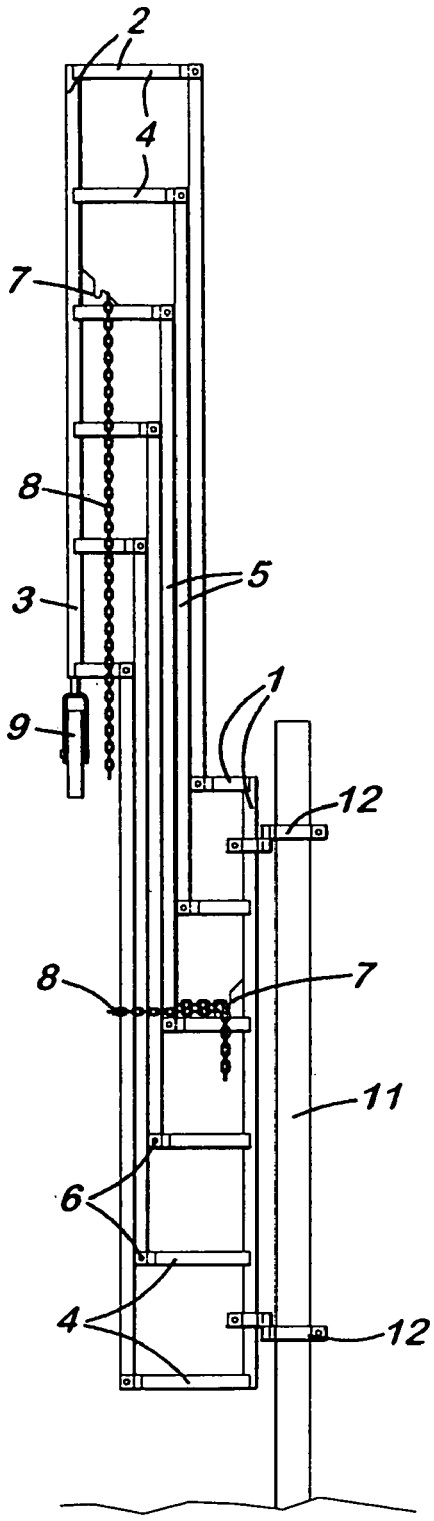
FIG. 5 is an elevated front view of the present invention with the rails swung to a complete vertical position and with the chain-and-hook arrangement.

FIG. 5 is an elevated front view of the present invention with the rails swung to a complete vertical position. It is the pivots 6 in combination with the novel design of the cross-bars 4, and in particular the differing lengths of the cross-bars 4, that allows for the rails to be swung a full ninety degrees upward. The rails could also be swung up to eighty degrees downward if that were desired for any reason. As shown in this figure, the rails 5 can be secured while in a completely upright position by a chain 8 that rests in the chain hook 7. This configuration makes the present invention much easier to transport than a welded gate that cannot be compacted.

Figure 6:
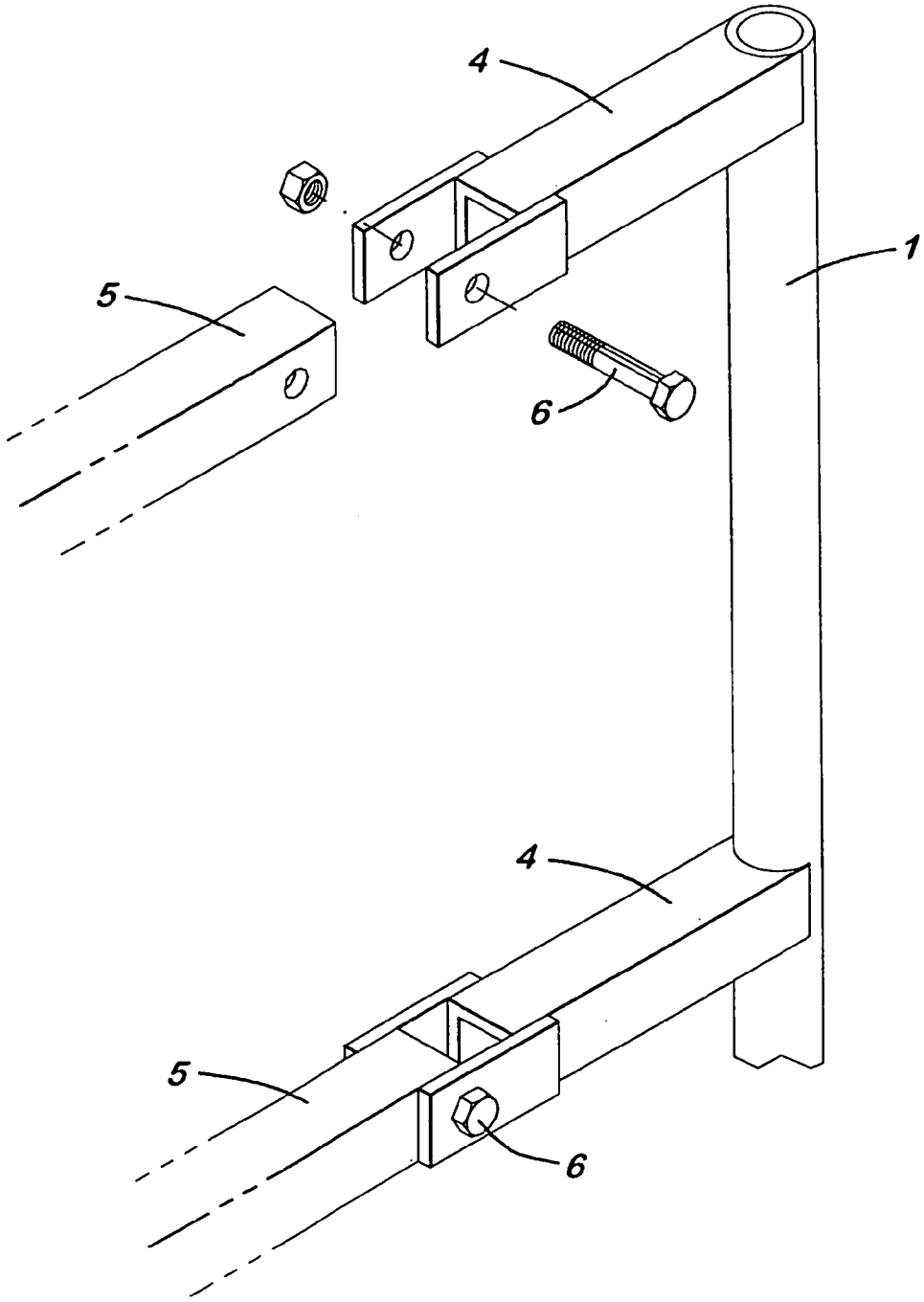
FIG. 6 is a partial perspective view of the present invention that shows how the rails fit into the cross-bars.
Figure 7:
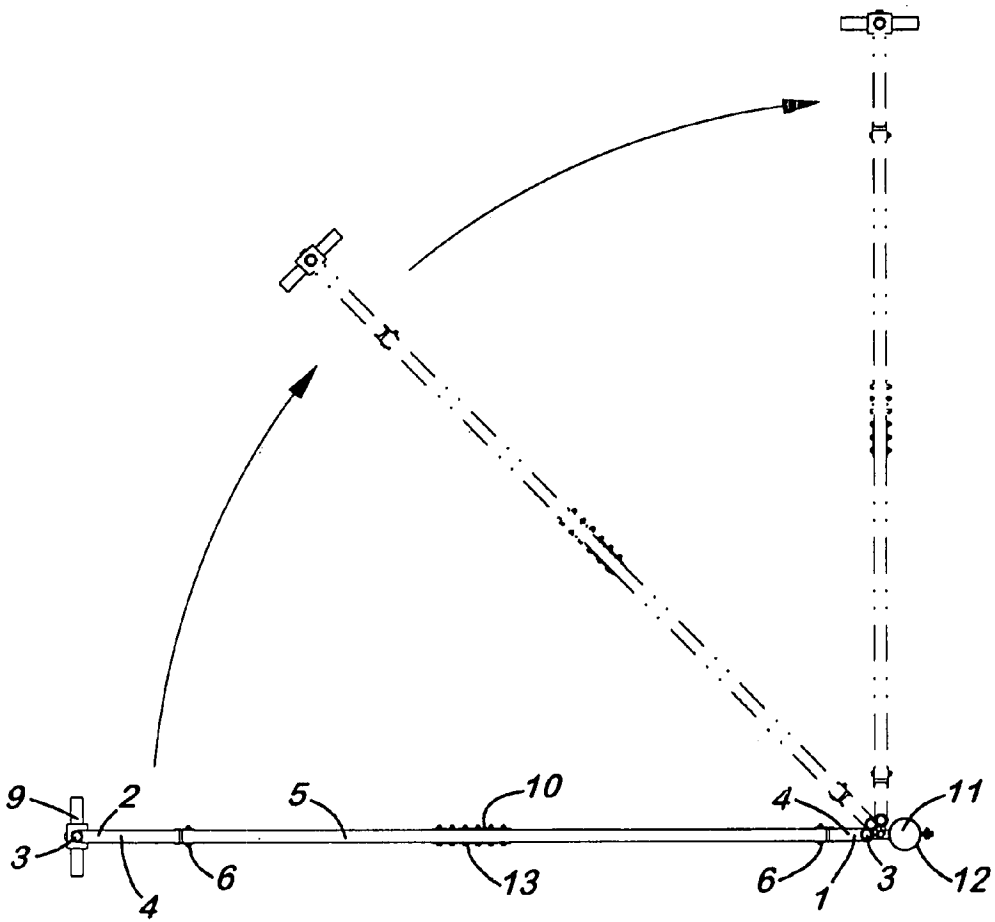
FIG. 7 is a top view of the present invention with the gate in an open position.

FIG. 6 is a partial perspective view of the present invention that shows how the rails fit into the cross-bars. The end of the cross-bar 4 that is farthest from the vertical post 3 is shaped to provide a shelf into which the rail 5 fits. The rail 5 is secured to the cross-bar 4 by a bolt with a self-locking nut, which allows the rail to pivot. FIG. 7 is a top view of the present invention with the gate in an open position.

Figure 8:
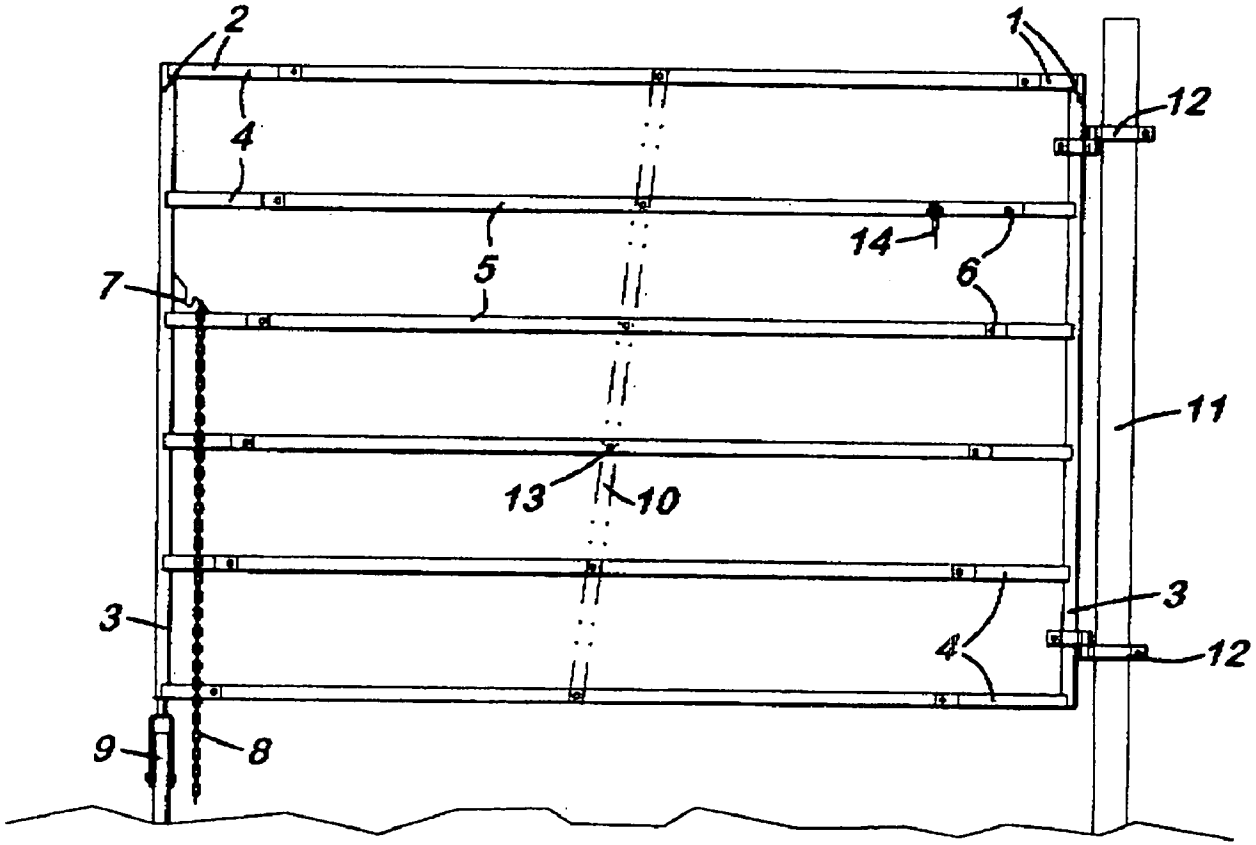
FIG. 8 is an elevated front view of the present invention in a true horizontal position without any vertical swing and with the spring clip pin arrangement.
Figure 9:
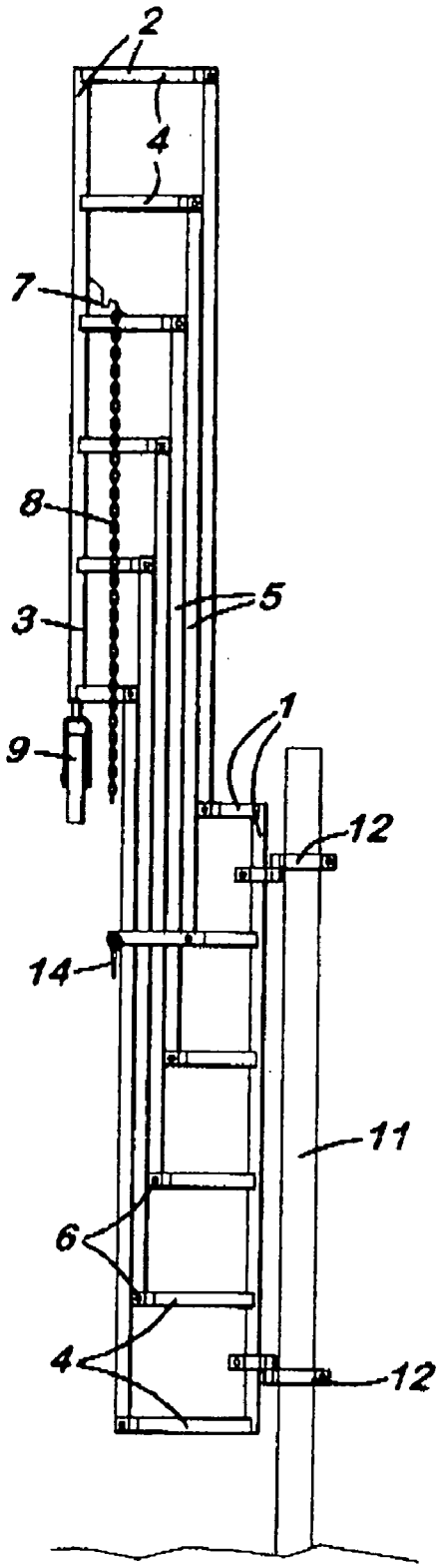
FIG. 9 is an elevated front view of the present invention with the rails swung to a complete vertical position and with the spring clip pin arrangement.

FIG. 8 illustrates an alternate embodiment for the chain-and-hook arrangement shown in FIGS. 1 through 5. Instead of a chain 7 and hook 8, the cross-bar 4 that is second from the top is extended, and a spring clip pin 14 is inserted through a hole in the end of the cross-bar and through the rail that fits into this cross-bar. The purpose of the spring clip pin is to hold the gate in place and prevent the rails from pivoting during transport or installation. As shown in FIG. 9, this same configuration holds the gate in place when fully swung vertically. The extension of the second cross-bar is long enough so that all of the lower rails, when in a full upright position, fit within this second cross-bar, and the spring clip pin 14 holds the rails in place.

By virtue of the pivots 6, the wheel 9, and the cross-bars 4 of differing lengths, the present invention allows much of the weight of the gate to be shifted from the first frame 1, the gate post 11 and the hinges 12 to the second frame 2 and wheel 9. This redistribution of the weight of the gate eliminates much of the stress that is ordinarily placed on gate hinges and gate posts, it eliminates the need for guy wires, and it ensures durability of the present invention over time. The ability of the gate of the present invention to open and close over uneven terrain allows this gate to be located in areas in which other gates would not function properly. In addition, the gate of the present invention can be lifted vertically up through drifted snow so that snow removal equipment can pass through the gate without the need to remove the snow first.

Figure 10:
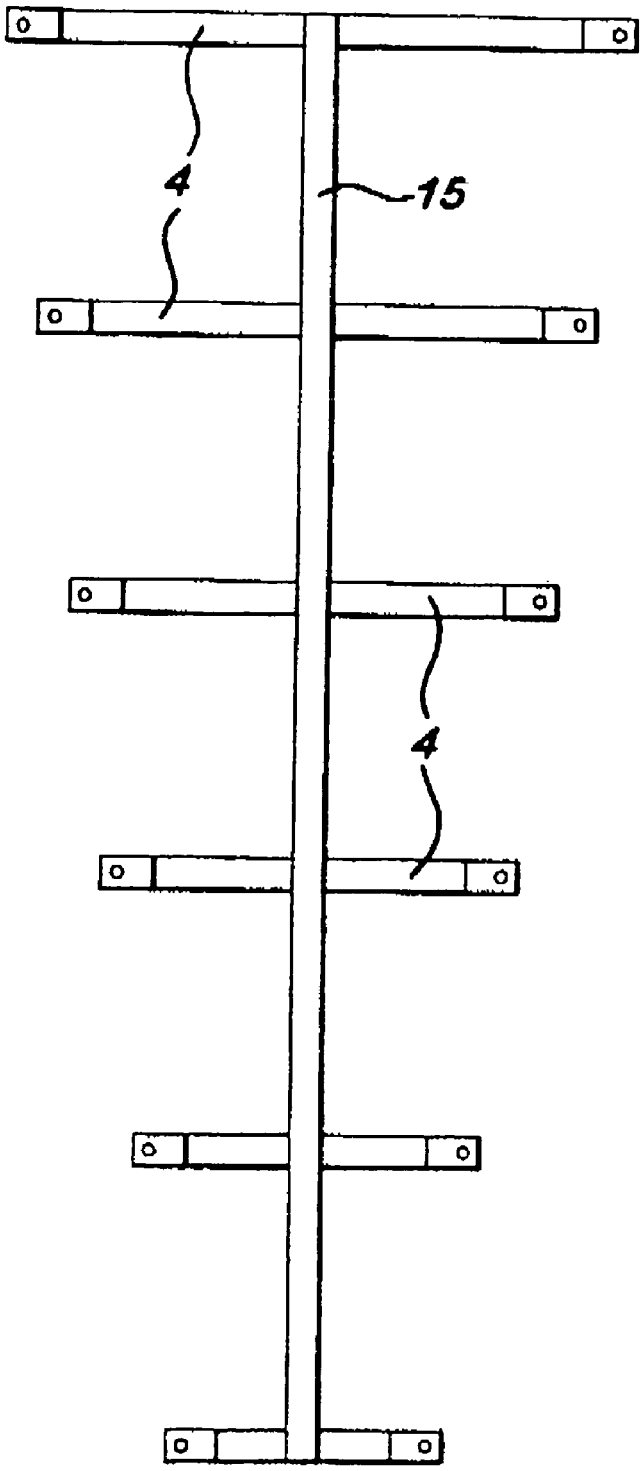
FIG. 10 is a perspective view of the double pivoting center support of the present invention.

When an eight-foot gate is locked into its full upright position as shown in FIG. 5, the total height of the gate will be twelve feet. Recognizing that this configuration may not work in all situations, the present invention optionally includes a double pivoting center support 15, as shown in FIG. 10. The term "double pivoting" is used to describe this type of center support because the rails pivot on both sides of the center support, thus allowing the gate to fold in the middle. In this configuration, the center support 15 has cross-bars 4 into which the rails 5 fit. In the preferred embodiment, the length of the cross-bars 4 decreases from top to bottom, and the difference in length between each consecutive cross-bar is at least equal to the width of one of the rails 5. With this type of center support, the gate will be slightly wider but less high when swung into its full vertical position, as shown in FIG. 11. FIG. 11A provides further detail regarding the spring clip pin aspect of the present invention. Any securing means could be used that achieves the same purpose as the spring clip pin.

Figure 12:
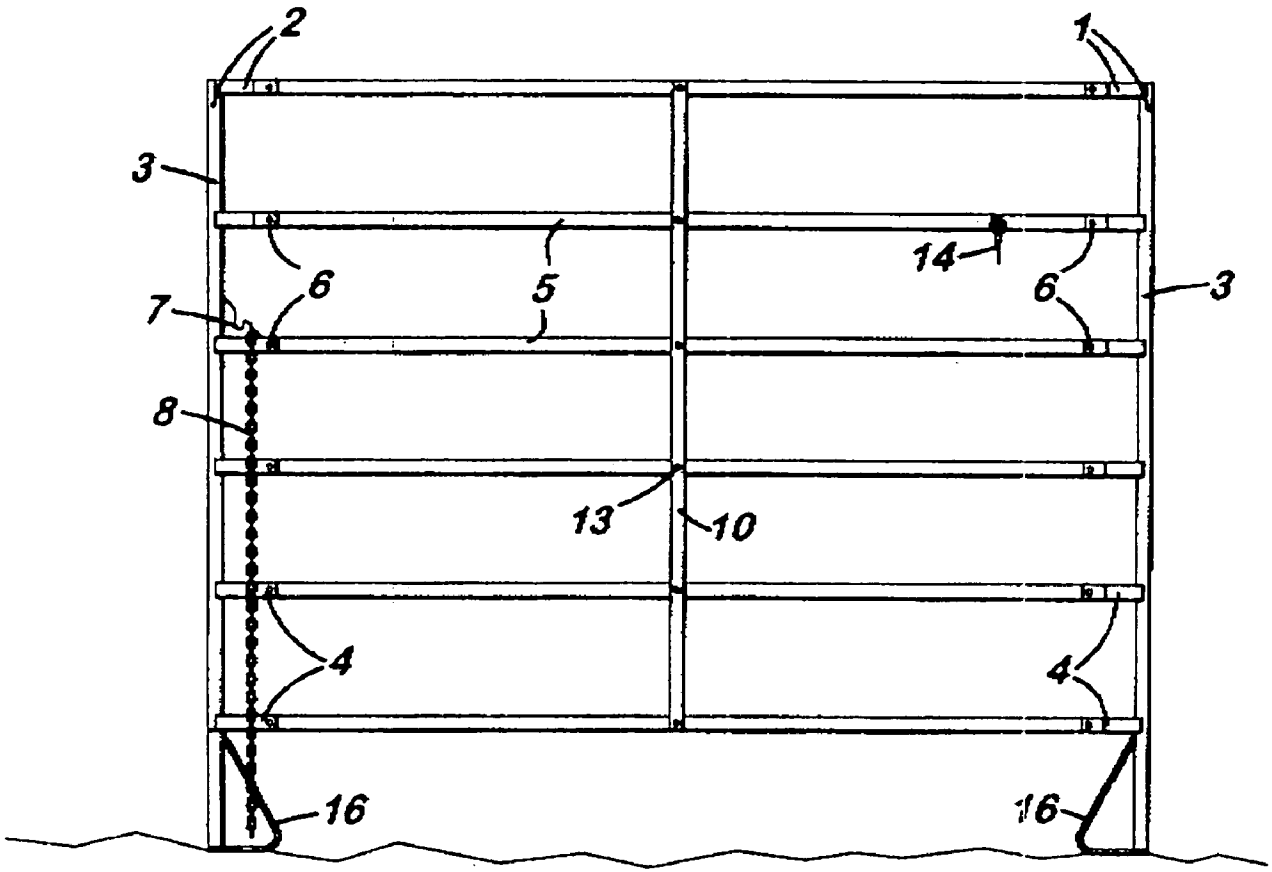
FIG. 12 is an elevated front view of the corral panel embodiment of the present invention in a true horizontal position without any vertical swing.

In addition to being used as a gate, the present invention, with slight modifications, can also be used as a corral panel. In this embodiment, which is illustrated in FIG. 12, the cross-bars 4 are of equal lengths, and there is a mud shoe 16 on the bottom of each vertical post 3. The vertical posts can be round or square, depending on the method by which the cross-bars 4 are attached to the vertical posts 3, and the mud shoes can be of any size. In this embodiment, the rails can swing up to sixty degrees vertically (not shown). The spring clip pin arrangement shown in FIG. 8 can be used with the corral panel embodiment, but because the rails do not swing to a full vertical position, the spring clip pin cannot be used to hold the rails in an upright position.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A gate apparatus comprising a first frame, a second frame and a plurality of rails, wherein each of the first and second frames comprises a vertical post and a plurality of cross-bars, wherein the plurality of cross-bars on each of the first and second frames comprises a top cross-bar and a bottom cross-bar, wherein each rail comprises a first end and a second end, wherein the first end of each rail is pivotally connected to a cross-bar of the first frame and the second end of each rail is pivotally connected to a cross-bar of the second frame, wherein the cross-bars of the first frame increase in length from the top cross-bar to the bottom cross-bar, and the difference in length between each cross-bar and the one below it is at least equal to the width of each rail, wherein the cross-bars of the second frame increase in length from the bottom cross-bar to the top cross-bar, and the difference in length between each cross-bar and the one above it is at least equal to the width of each rail, wherein the cross-bar that is second from the top is extended by a length that is at least equal to the combined width of all of the rails beneath the one that fits into this second cross-bar.

2. The gate apparatus of claim 1, further comprising a means for securing the second cross-bar to the rail that fits into the second cross-bar.

3. A gate apparatus comprising a first frame, a second frame, a plurality of rails, and a center support attached to the rails, wherein each of the first and second frames comprises a vertical post and a plurality of cross-bars, wherein the plurality of cross-bars on each of the first and second frames comprises a top cross-bar and a bottom cross-bar, wherein the cross-bars of the first frame increase in length from the top cross-bar to the bottom cross-bar, and the difference in length between each cross-bar and the one below it is at least equal to the width of each rail, wherein the cross-bars of the second frame increase in length from the bottom cross-bar to the top cross-bar, and the difference in length between each cross-bar and the one above it is at least equal to the width of each rail, wherein the center support comprises two sets of cross-bars, one on either side of the center support, wherein each rail comprises a first end and a second end, wherein the first end of each rail is pivotally attached to a cross-bar of either the first or second frame, and wherein the second end of each rail is pivotally attached to a cross-bar of the center support such that the rails pivot vertically on either side of the center support and such that the gate apparatus folds in the center when swung vertically upward or downward.

4. The gate apparatus of claim 3, wherein the cross-bars of the center support decrease in length from top to bottom.

5. The gate apparatus of claim 4, wherein the difference in length between each consecutive cross-bar is at least equal to the width of one of the rails.

* * * * *